US010273601B2

(12) United States Patent
Miglus

(10) Patent No.: US 10,273,601 B2
(45) Date of Patent: Apr. 30, 2019

(54) MULTI-IMAGE GRAPHICAL WEAVE

(71) Applicant: ILOROM, LLC, Providence, RI (US)

(72) Inventor: Wanda M. Miglus, Providence, RI (US)

(73) Assignee: ILOROM, LLC, Providence, RI (US)

( * ) Notice: Subject to any disclaimer, the term of this patent is extended or adjusted under 35 U.S.C. 154(b) by 197 days.

(21) Appl. No.: 15/269,329

(22) Filed: Sep. 19, 2016

(65) Prior Publication Data

US 2017/0081791 A1 Mar. 23, 2017

Related U.S. Application Data

(60) Provisional application No. 62/219,697, filed on Sep. 17, 2015.

(51) Int. Cl.
*D03D 13/00* (2006.01)

(52) U.S. Cl.
CPC ..... *D03D 13/004* (2013.01)

(58) Field of Classification Search
CPC ..... D03D 13/004
See application file for complete search history.

(56) References Cited

U.S. PATENT DOCUMENTS 8,550,124 B2 * 10/2013 Tsai ..... D03D 15/0033 139/420 R
2004/0261883 A1 * 12/2004 Harrison ..... D03D 11/00 139/383 A

* cited by examiner

*Primary Examiner* — Andrew Wayne Sutton
(74) *Attorney, Agent, or Firm* — Adler Pollock & Sheehan P.C.; Daniel J. Holmander, Esq.

(57) ABSTRACT

A method for weaving a multi-image graphical fabric including the step of assigned groups, each group having first, second and third yarns, wherein a first group has the first yarn being for a valley position in a most suppressed position and the second and third yarns being a first pair for a slope position in relatively raised positions, a second group has a first yarn for a ridge position with the second and third yarn forming a second pair for a slope in a descending position resulting in a combination of six fill yarns across twelve warp ends to form a weave unit so that three separate and distinct image fields are created in a face of the fabric and viewing angle determines which image field is seen.

7 Claims, 12 Drawing Sheets

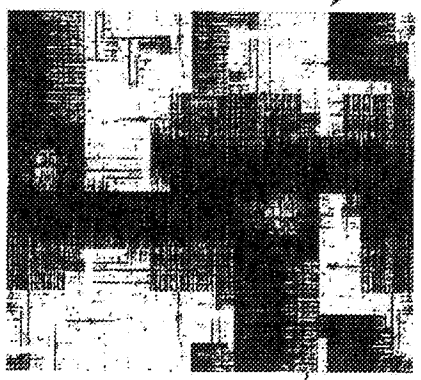
Fig. 2A
Fig. 2B
Fig. 2C
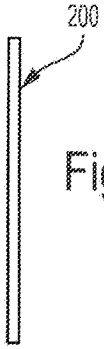
Fig. 2D
SIDE VIEW

MULTI-IMAGE GRAPHICAL WEAVE

CROSS-REFERENCE TO RELATED APPLICATION

This application claims priority to U.S. Provisional Patent Application No. 62/219,697, filed Sep. 17, 2015, which is incorporated herein by reference.

BACKGROUND

1. Field

The subject disclosure relates to methods and systems for producing animated fabric, and more particularly to improved methods and systems for animated fabric with a plurality of different patterns depending the viewing angle.

2. Background of the Related Art

The Multi-Image Graphical Weave is born out of earlier development of a weave structure that created a fabric having two images on its front surface that transition between and replace one another visually depending on the viewing angle. See, for example, U.S. Pat. No. 5,560,401 entitled "Animated Multi-Image Fabric and Method of Producing the Same" and issued to Miglus on Oct. 1, 1996 ('401 Patent). The existing transitioning image weave technology of the '401 Patent provides for only two images to change from one graphic frame to the other, as the viewers angle changes. This limits the visual, aesthetic and compositional possibilities of the transition between images to frame A or B.

Additional examples are some of the textile technologies that have transitioning image surfaces include a knitting technique called "shadow knitting" or "illusion knitting", in which an image is seen from one viewing direction and disappears from the opposite direction. This technique has been employed commercially (upholstery fabric designed by Jhane Barnes for Knoll Textiles in the late 80's or early 90's), as well as in hand-craft. Of a similar nature there is reportedly an example of woven fabric dating back to the 1800's or early 1900's in which an image appears from one direction and is replaced by no image in the other viewing direction, in the historical archives at the Metropolitan Museum of Art, New York City. In 2014, the Italian carpet company Golran, S.r.l. introduced the Lake Collection of sculpted pile rugs with 2-way optical effects, and in 2005 the Mohawk Industries, Lees Carpets introduced a tufted carpet with transitioning patterns between opposite viewing directions. Other related non-woven references include the optical constructs of lenticular graphic items and holograms, some pre-cinemagraphic toys that had three planes displaying images, and the optically kinetic art works of Yaacov Agam, who's techniques have been adapted to commercial billboard systems. Another example is Patent Cooperation Treaty Pub. No. WO 1994015492 A1, which published on Jul. 21, 1994 (Patent Cooperation Treaty Serial No. PCT/AU1994/000020). It discloses a substrate with embroidery or secondary stitching thereon.

SUMMARY

A need still exists for animated fabric in which the images are durable and longlasting because the images are actually part of the fabric rather than a mere embellishment.

Primary applications for the subject technology are any field where typical fabric or other pliable or interlaced materials are used for surface coverage or as structural materials. These include, but are not limited to, the design field for the interior and exterior of living, work, leisure, recreational, and transportations spaces. Consumer products are also able to use the subject technology such as sports equipment and accessories, home goods and furnishings and electronics. Additionally, other areas include: fashion apparel and accessories; safety and military industries; automotive interiors; exterior surfaces in the building and architectural industries; and fine, performance and commercial arts. Still further, the subject technology has optical characteristics may have application in technology, science and medicine.

The subject technology achieves a more fully realized animated effect by providing more than two optically-active facets or image frames. One exemplary embodiment is directed to woven or interlaced materials with visually transitioning designs or graphic elements having three or four image-frames.

The subject technology improves the visual transitioning of images in the fabric by adding a third image frame. The third frame performs the following functions: a) adds a third independent graphic into the fabric which will allow for three distinct image changes; b) adds a center sequencing image into the the fabric that will allow for a smoother visual transition between the other two optical facets or image frames; and c) creates a more enhanced devision, or visual break, between the other two optical facets or image frame. The sum of which will create a more complex use of image or pattern transitioning in a woven material. A fourth frame provides similar benefits.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings.

FIG. 2A illustrates a pattern for a first frame of an animated fabric in accordance with the subject technology.

FIG. 2B illustrates a pattern for a second frame of the animated fabric of FIG. 2A in accordance with the subject technology.

FIG. 2C illustrates a pattern for a third frame of the animated fabric of FIG. 2A in accordance with the subject technology.

FIG. 2D is a side view of the fabric of FIG. 2A in accordance with the subject technology.

DESCRIPTION OF PREFERRED EMBODIMENTS

The advantages, and other features of the technology disclosed herein, will become more readily apparent to those having ordinary skill in the art from the following detailed description of certain preferred embodiments taken in conjunction with the drawings which set forth representative embodiments of the present technology. It is noted that directional terms (e.g., up, down, left, right, horizontal, vertical etc.) are used below with respect to the figures and not meant in a limiting sense.

The subject technology creates a visual activity in a fabric by the shifting and changing of patterns on the face surface, which in turn provides a visually stimulating experience to the viewer and avails a new expressive medium for designers. The effect is integral to the structure of the fabric, not limited by yarn type and not susceptible to wearing away. Jacquard weaving machines, which are a commercial standard, are preferred for production of the resulting fabric. Special materials and set ups are not required, making it competitive with standard quality woven fabric production. The woven fabric meets standards for performance and durability in the benchmark 'contract' (e.g., commercial office furnishings) textile field and because patterns and yarn types can be easily updated its lifespan as a weave structure can join the ranks of weaves that have been in continuous use for hundreds of years.

In brief overview, the subject technology is the next iteration of a weave structure that results in a woven fabric with integrated graphic images that transition visually from one to the next. The subject technology has a structure of the weave to increase the number of optical facets from two to either three or four. In one example, a third image delivery surface is integrated into the face of the fabric to enhance the elegance and complexity of the graphic transitioning possibilities. This third image plane will then act to deliver a third image or as a visual break between the image delivery planes on either side of it.

Figure 1C:
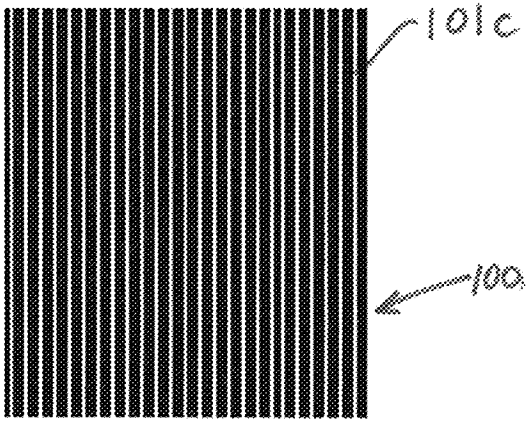
FIG. 1C illustrates a pattern for a third frame of the animated fabric of FIG. 1A in accordance with the subject technology.
Figure 1B:
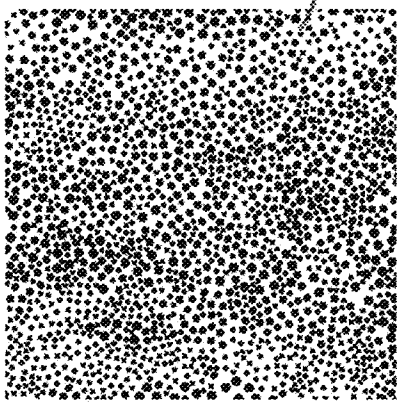
FIG. 1B illustrates a pattern for a second frame of the animated fabric of FIG. 1A in accordance with the subject technology.
Figure 1A:
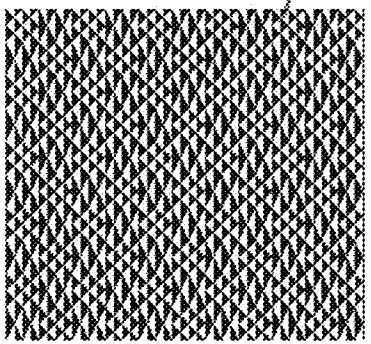
FIG. 1A illustrates a pattern for a first frame of an animated fabric in accordance with the subject technology.
Figure 1F:
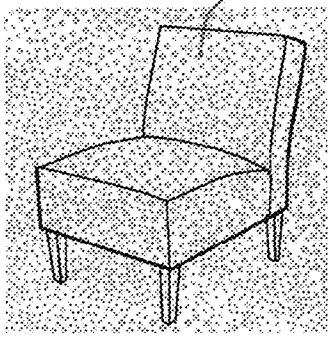
FIG. 1F is a right perspective view of an item, namely a chair, that may be upholstered with the animated fabric of FIG. 1A-C to illustrate the second frame pattern in accordance with the subject technology.
Figure 1G:
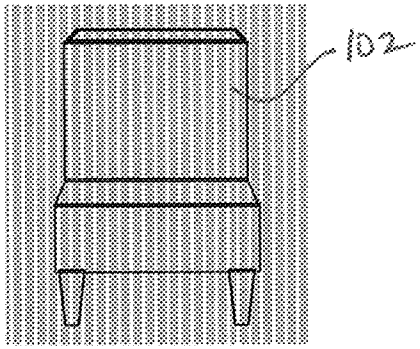
FIG. 1G is a front view of a chair upholstered with the animated fabric of FIG. 1A-C to illustrate the third frame pattern in accordance with the subject technology.
Figure 1E:
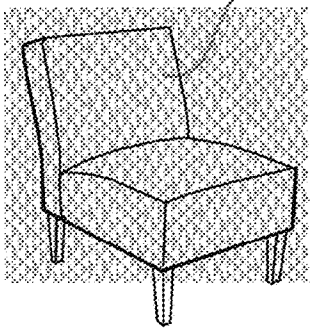
FIG. 1E is a left perspective view of a chair upholstered with the animated fabric of FIG. 1A-C to illustrate the first frame pattern in accordance with the subject technology.

Referring now to FIGS. 1A-C, patterns for three frames 101*a-c* of an animated fabric 100 in accordance with the subject technology are shown. As can be seen in FIG. 1E, the first pattern 101*a* (e.g., various triangles) would be visible when viewing an upholstered chair 102 from the left (i.e., at an acute angle). As can be seen in FIG. 1F, the second pattern 101*b* (e.g., various dots) would be visible when viewing an upholstered chair 102 from the right. As can be seen in FIG. 1G, the third pattern 101*c* (e.g., vertical stripes) would be visible when viewing an upholstered chair 102 from the front (i.e., a perpendicular angle). It is noted that the designs are not necessarily illustrated to scale.

Figure 1D:
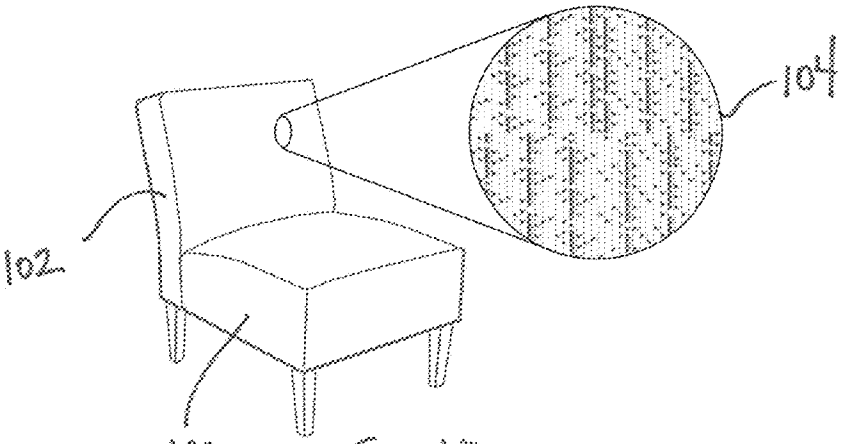
FIG. 1D is a perspective view of an item, namely a chair, that may be upholstered with the animated fabric of FIG. 1A-C having a detailed inset circle in accordance with the subject technology.

Referring to FIG. 1D, a perspective view of the chair 102 is shown with a detailed inset circle 104 to illustrate an upholstering approach. The animated fabric 100 is presented in the railroaded or horizontal direction as would be prevalent in most furniture applications though the "up the roll" or vertical application is also relevant to the accomplished optical effect.

Referring now to FIGS. 2A-C, patterns for three frames 201*a-c* of an animated fabric 200 in accordance with the subject technology are shown. Again patterns 201*a*, 201*b* would be visible when viewing an upholstered chair from the acute angles wherein the third pattern 201*c* would be visible when viewing an upholstered chair from a substantially perpendicular angle. FIG. 2D is a side view of the fabric 200 of FIGS. 2A-C. Back views would be substantially similar to the front views. Similarly, the side views of other fabrics shown herein would be the same and again, back views are substantially similar to front views although in some instances, the patterns are reversed as would be appreciated by those of ordinary skill in the art.

Figure 3C:
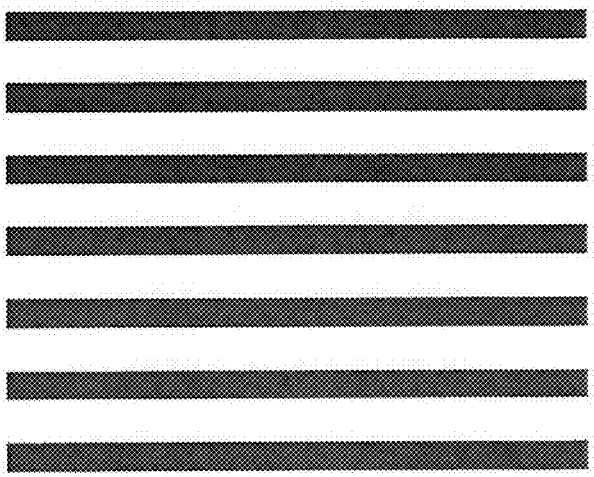
FIG. 3C illustrates a pattern for a third frame of the animated fabric of FIG. 3A in accordance with the subject technology.
Figure 3B:
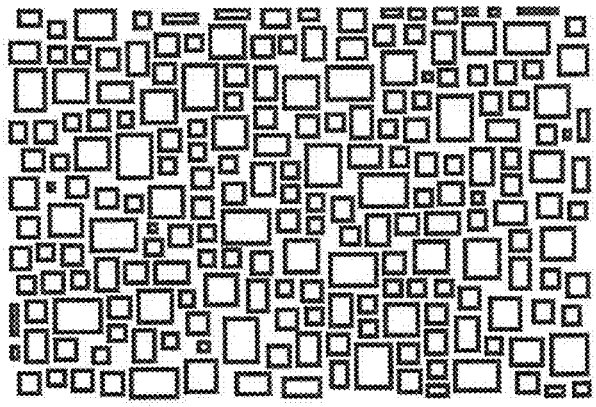
FIG. 3B illustrates a pattern for a second frame of the animated fabric of FIG. 3A in accordance with the subject technology.
Figure 3A:
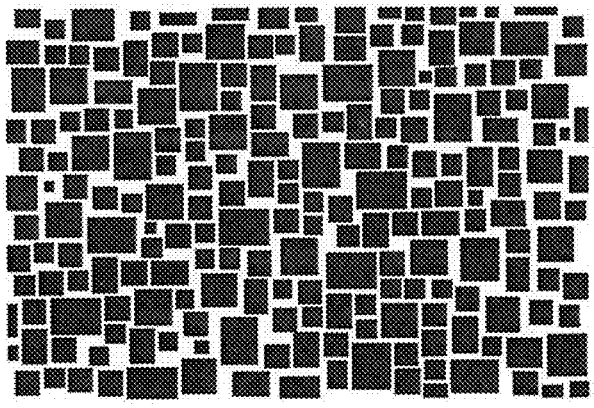
FIG. 3A illustrates a pattern for a first frame of an animated fabric in accordance with the subject technology.

Referring now to FIGS. 3A-C, patterns 201*a-c* for three frames of an animated fabric 200 in accordance with the subject technology are shown. Again patterns 201*a*, 201*b* would be visible when viewing an upholstered chair from the acute angles wherein the third pattern 201*c* would be visible when viewing an upholstered chair from a substantially perpendicular angle. It is envisioned that the changing optical effect may be substantially diminished on the reverse/back of the fabric. In one embodiment, a mix of the three images is present on the back.

Referring again to FIGS. 1A-C, preferably, the first and second frames 101*a*, 101*b* are any kind of rendered design, pattern or image such as figurative or geometric. In contrast, the third frame 101*c* utilizes geometric constructs of vertical and/or horizontal patterns that can be created through color, texture and tonal qualities of interlaced yarns. The third frame 101*c* can also be a distinct spacer between frames 101*a*, 101*b* by being a simple field of color, tone and/or texture without graphic delineation. The third frame 101*c* can also accommodate more organic patterns or designs that are applied directly to the yarn itself before being integrated into the fabric 100 in a proper position in the weaving process.

Figure 4:
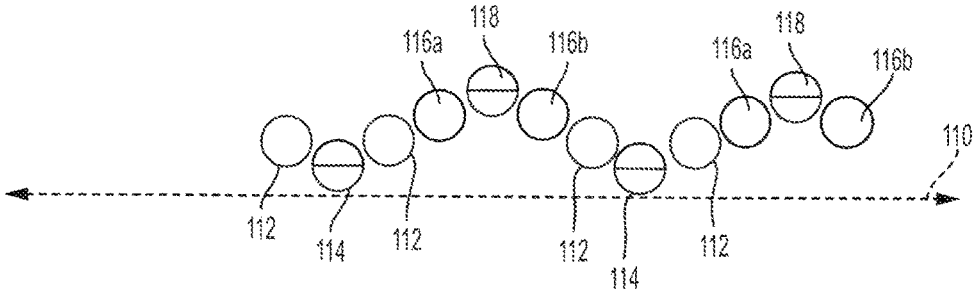
FIG. 4 is a cross-sectional view of a woven construction in accordance with the subject technology.

Referring now to FIG. 4, a cross-sectional view of a woven fabric 100 is shown with reference to a warp yarn direction 110. Regarding the fill yarns, the lower yarn pairs 112 are the same tonal value. The valley yarns 114 act as a visual spacer between the acute design images (e.g., frames 101*a*, 101*b*). The peak yarns 118 also works with the valley yarns 114 to act as a visual spacer between the acute design images (e.g., frames 101*a*, 101*b*). The peak yarns 118 are also of the same tonal value. The middle yarns 116*a*, to the left of the peak yarns 118, designate the image in frame 101*a*. The middle yarns 116*b*, to the right of the peak yarns 118, designate the image in frame 101*b*. The tonal value of the peak yarns 118 and the valley yarns 114 can be adjusted to accommodate the desired range of contrast as needed.

Figure 5A:
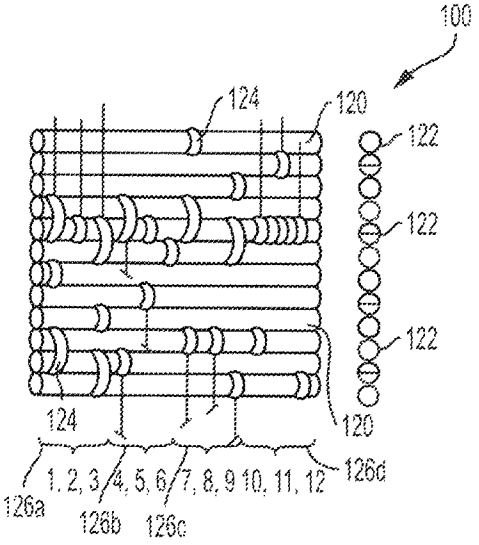
FIG. 5A is a stylized view of a portion of fabric in accordance with the subject technology.

Referring now to FIG. 5A, a stylized view of a portion 120 of fabric 100 in accordance with the subject technology is shown. The portion 120 has a plurality of horizontal threads 122. It is noted that a cross-sectional view of each horizontal thread 122 is also shown adjacent the portion 120 of fabric 100. The portion 120 also illustrates the warp ends 124 running vertically therethrough. The warp ends 124 are grouped into 4 sections 126*a-d*, each section 126*a-d* having three warp ends 124 that correlate with FIG. 5B.

Figure 5B:
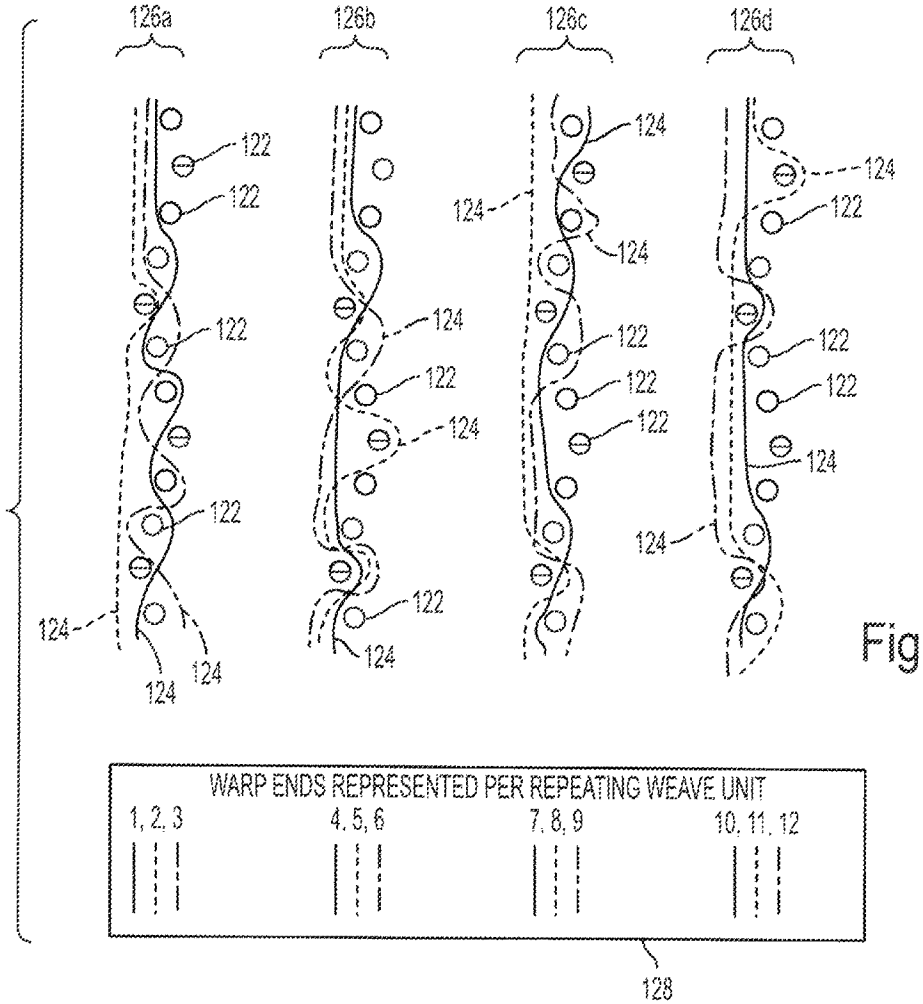
FIG. 5B is a series of cross-sectional views of the fabric of FIG. 5A.
Figure 6B:
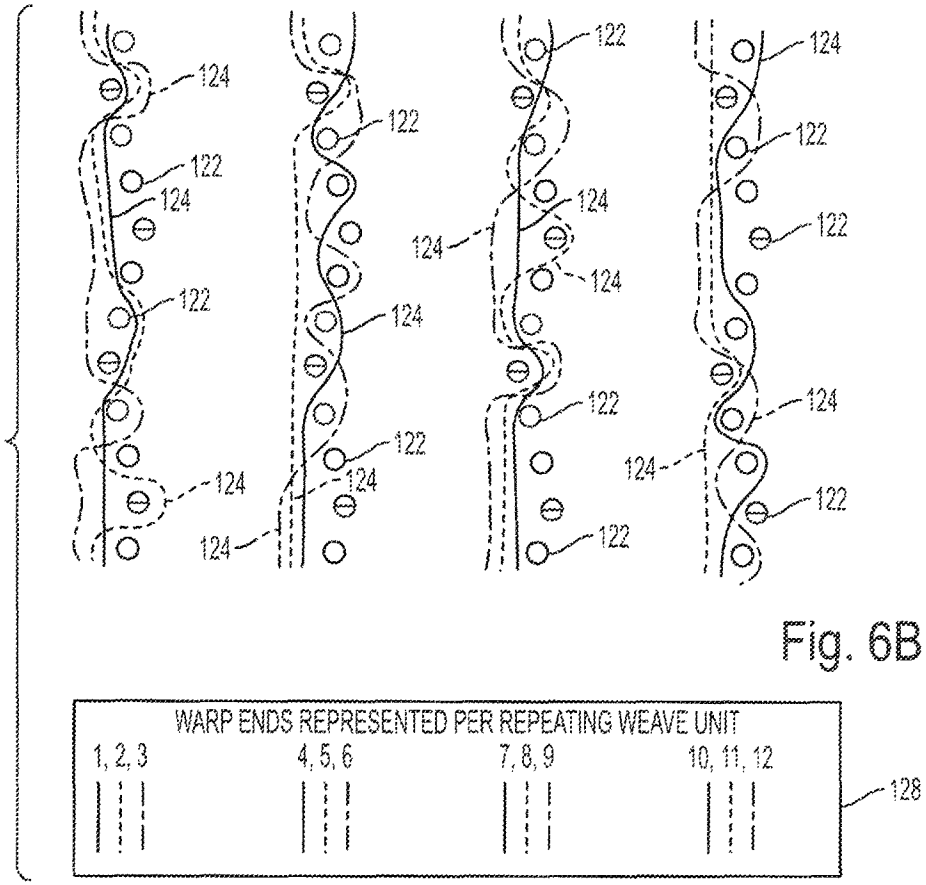
FIG. 6B is a series of cross-sectional views of the fabric of FIG. 6A.
Figure 6A:
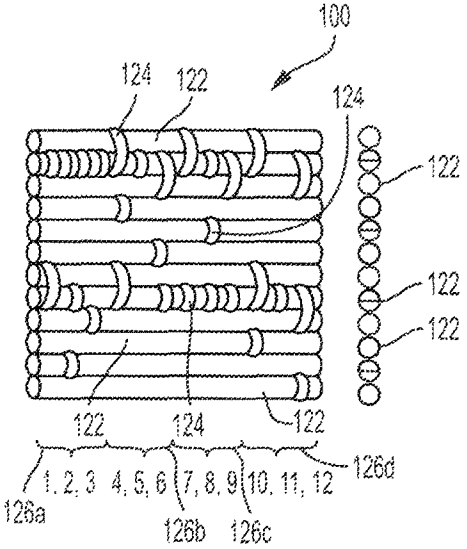
FIG. 6A is a stylized view of another portion of fabric in accordance with the subject technology.
Figure 7B:
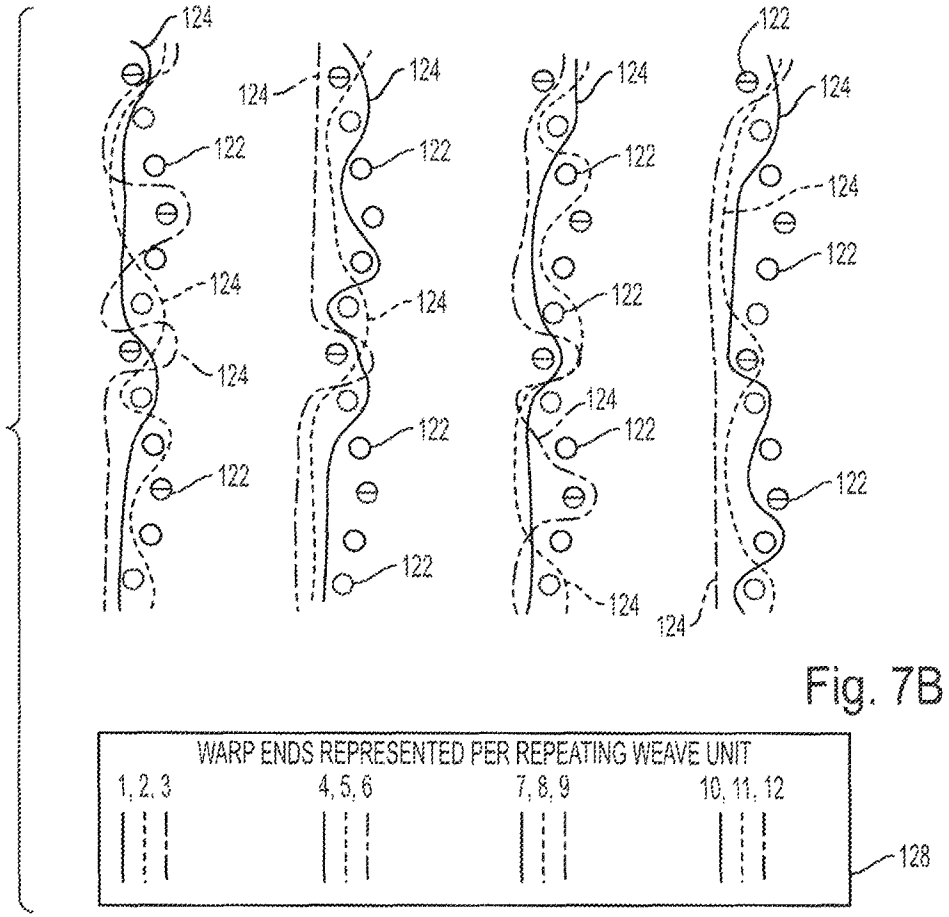
FIG. 7B is a series of cross-sectional views of the fabric of FIG. 7A.
Figure 7A:
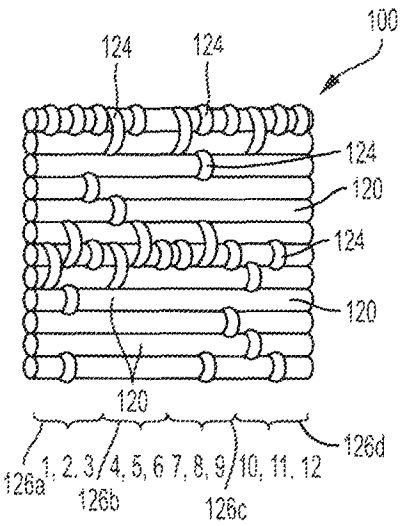
FIG. 7A is a stylized view of yet another portion of fabric in accordance with the subject technology.
Figure 8B:
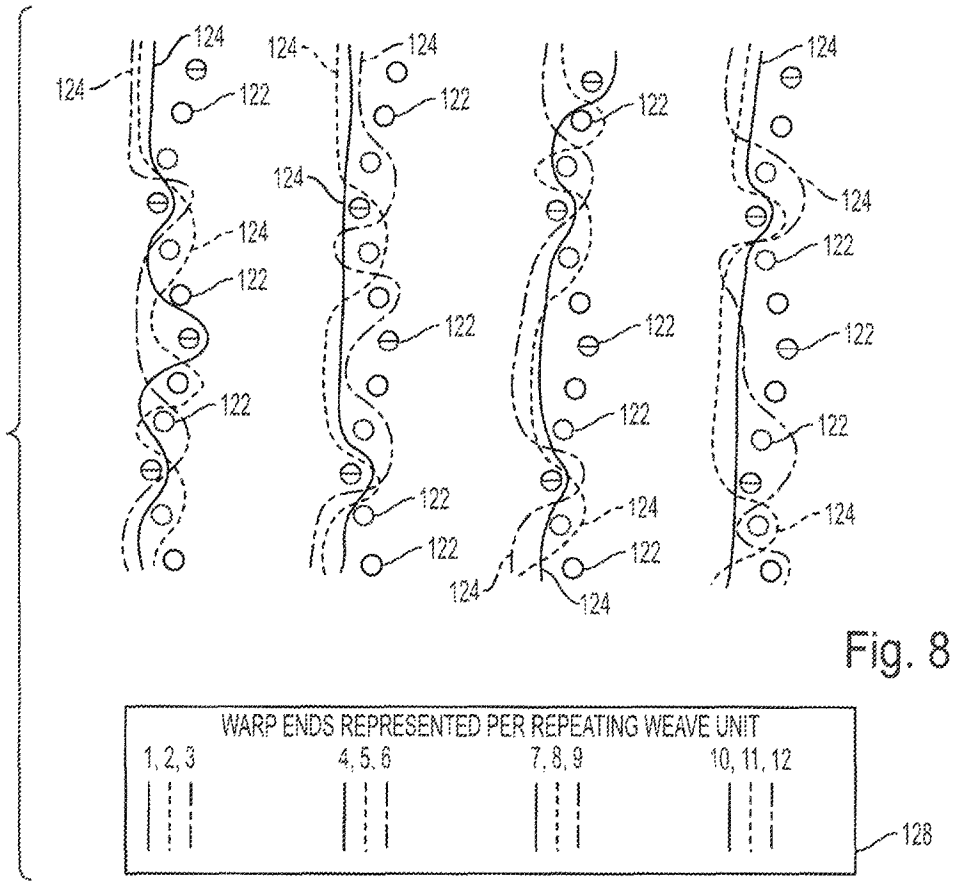
FIG. 8B is a series of cross-sectional views of the fabric of FIG. 8A.
Figure 8A:
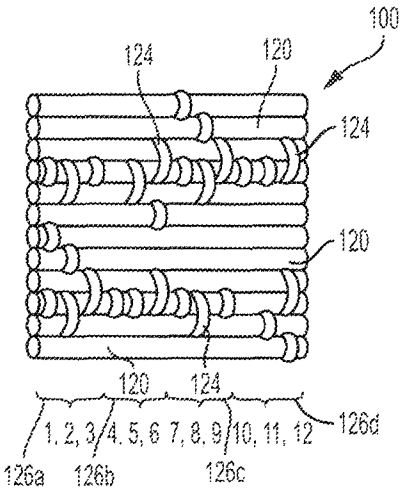
FIG. 8A is a stylized view of still another portion of fabric in accordance with the subject technology.

Referring now to FIG. 5B, a series of cross-sectional views of the fabric 100 of FIG. 5A is shown. FIG. 5B includes a legend 128 for identifying the warp ends 124 threaded through the horizontal threads 122. As can be seen, the patterns are woven into the fabric 100 and the thread weave across the entire fabric 100. FIGS. 6A-8B are additional portions 120 of the fabric 100 shown in a similar manner to further illustrate an embodiment of the subject technology.

As can be seen from the above, the subject technology is a multi-image graphical weave that presents three separate and distinct image fields into the face of fabric through the integral yarn interlacing process that is weaving construction. The arrangement of the yarns is such that as one image is visible the other images are obscured. This optical effect is visible on the face of the fabric. The three independent images are embedded in the fabric's construction and can be seen as distinct primary images depending on the viewing perspective. The images visually replace each other as the viewing perspective shifts from an acute angle to perpendicular angle and again to an acute angle along the warp yarn direction, or length of the fabric, in the cloth face. There are basically three viewing 'frames' of the defined images.

The three frame weave configuration creates distinct design options in which both outer frames (i.e., the left and the right frames) accommodate figurative image designs rendered through figure and ground delineation. The middle frame utilizes the directional vertical and horizontal design capabilities of the weaving process to create geometric areas. The geometric areas can be rendered as stripes, bands, blocks, plaids, checks, grids, etc. through combinations of color, tonal value, texture and reflective qualities by specific yarn selection.

The middle frame functions in distinct ways in relationship to the left and right frames. The middle frame can carry a design or it can be treated as a visual spacer, or break, between the figurative images in the left and right frames by being executed as a plane field of color, tone or texture without a delineated graphic. Because of the position the yarns occupy to form the middle frame, the middle frame functions differently than the left and the right frames. When viewed at a 90 degree angle, the middle frame becomes the primary surface occupying both the most prominent and subordinate position and becoming the visual focus. When viewing the fabric at acute angles away from perpendicular viewing position, the middle frame functions to obscure the tertiary image.

The subject technology imparts physical properties into the fabric as well. Regarding the fabric topography, the weaving structure allows the tension of the warp yarns to force the fill yarns into suppressed and raised positions in a systematic and repeating order. The result is a corrugated-like effect of ridges and valleys where one image plane becomes visually evident in the fill yarns from one direction and the other image plane becomes visually evident from the other direction. In between these two sloped sides reside the ridge and valley of the corrugated effect. The ridge and valley are created by a single yarn in each position rather than a pair, as are the sloped sides, and therefore presents a unified surface quality. When viewed from a perpendicular angle the prominence of the ridge plane in combination with the subordinate valley plane presents a distinct frontal surface. When the fabric is viewed from an acute angle the ridge plane further serves to obscure the figurative image on the opposite slope.

As described above, the weaving configuration may be assigned in groups of three yarns, one for the valley in the most suppressed position with a pair for the slope in a more raised positions. Then another yarn for the ridge with a pair for the slope in a descending position. This results in a combination of six fill yarns across twelve warp ends, which constitutes the basic interlace structure unit, or weave unit. A weave unit of twelve fill yarns (or rows) across twelve warp ends (or columns) is rendered for effective construction and specific application of the resulting fabric may require additional repeats of the basic interlace structure unit to accommodate strategic tack-down points for the fabrics functional utility.

The yarns used to form the left and right frames are preferably of a consistent or near constant diameter, whereas yarns used in the position that creates the middle frame can vary more widely in diameter and texture. Yarns assigned to the rows that create the left and right frames are paired in contrasting colors or tonalities to delineate the figure against the ground of the images to be depicted. Yarns assigned to the rows that create the middle frame allow for more independent selection according to what is required in each unique design. Other non-fiber strands and filaments can equally be used for this technique.

Each of the three images preferably conforms to the same repeat size and these in turn must be divisible into the final number of fill rows and warp columns making up the complete interlace draft. The fill rows run horizontally on the weave draft and perpendicular to the warp end columns. To achieve the integration of the three image frames, each of the images is separated into rows. The number of these rows corresponds to the number for fill yarn rows required for each image to complete the design repeat rotation and produce a consistent and evenly repeating length of material. The rows of the three designs are then collated in sequence and in coordination with the fill row assignment. Referring again to FIGS. 5A-8A, each portion 120 shown therein is a unique interlace unit.

Figure 9:
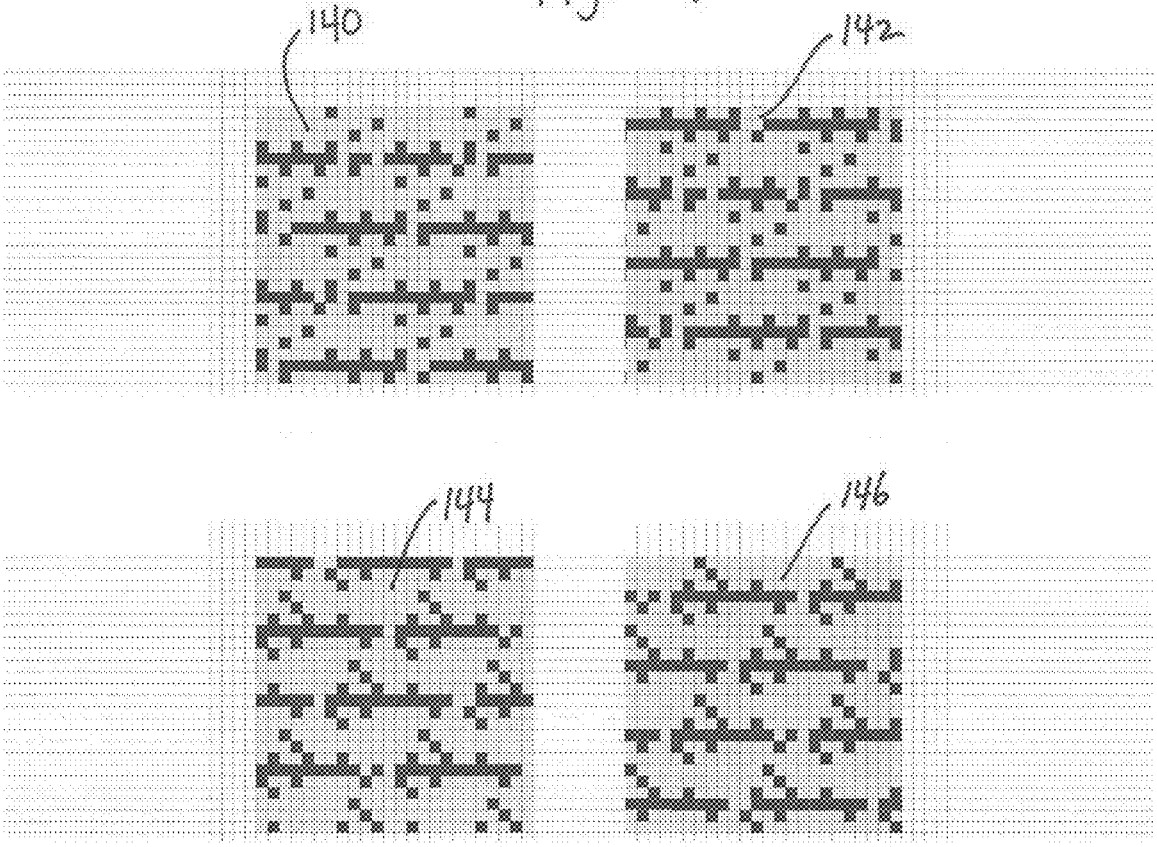
FIG. 9 is four interlace units for a weave arrangement in accordance with the subject technology.

Referring to FIG. 9, the four interlace units 140, 142, 144, 146 or drafts of the weave arrangement are shown. The interlace units 140, 142, 144, 146 designate how the images will correspond to one another when integrated and when different areas of figure and ground delineation connect at sequential fill rows and sequential warp ends.

Figure 10:
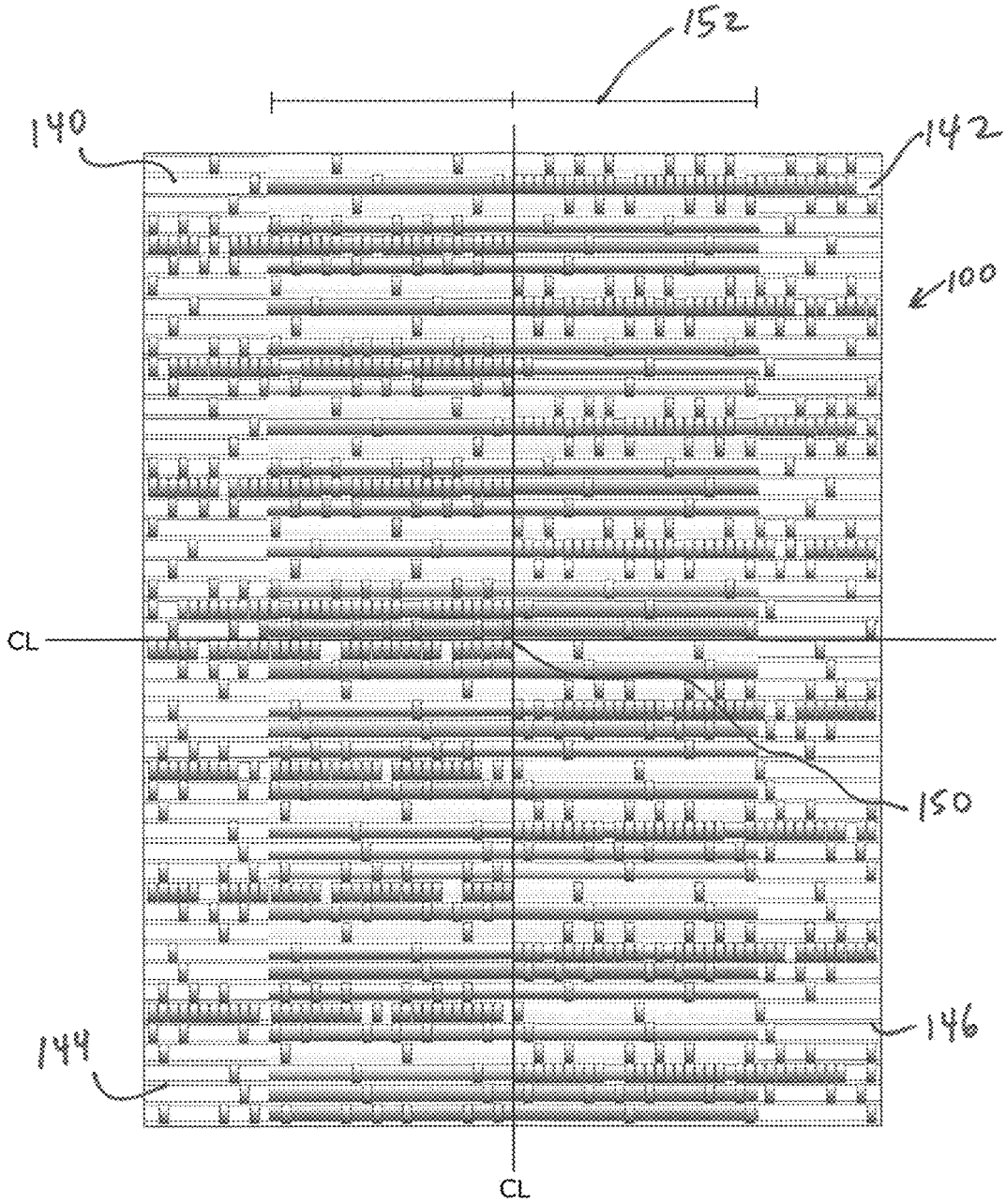
FIG. 10 is a depiction of the four interlace units joined at a a central point to form for a weave arrangement in accordance with the subject technology.

FIG. 10 is a depiction of the four interlace units 140, 142, 144, 146 joined at a central point 150 to form the fabric 100 (as if in FIG. 9 the units 140, 142, 144, 146 slid together so the inner corners touched). The repeat unit 152 is marked by lines on FIG. 10. In one embodiment, the horizontal yarns are all the same but in another the horizontal yarns vary, say in a brown-green-brown-yellow-green-yellow repeating pattern. The repeat unit is the top-to-bottom section of the fabric shown in FIG. 10.

Figure 11:
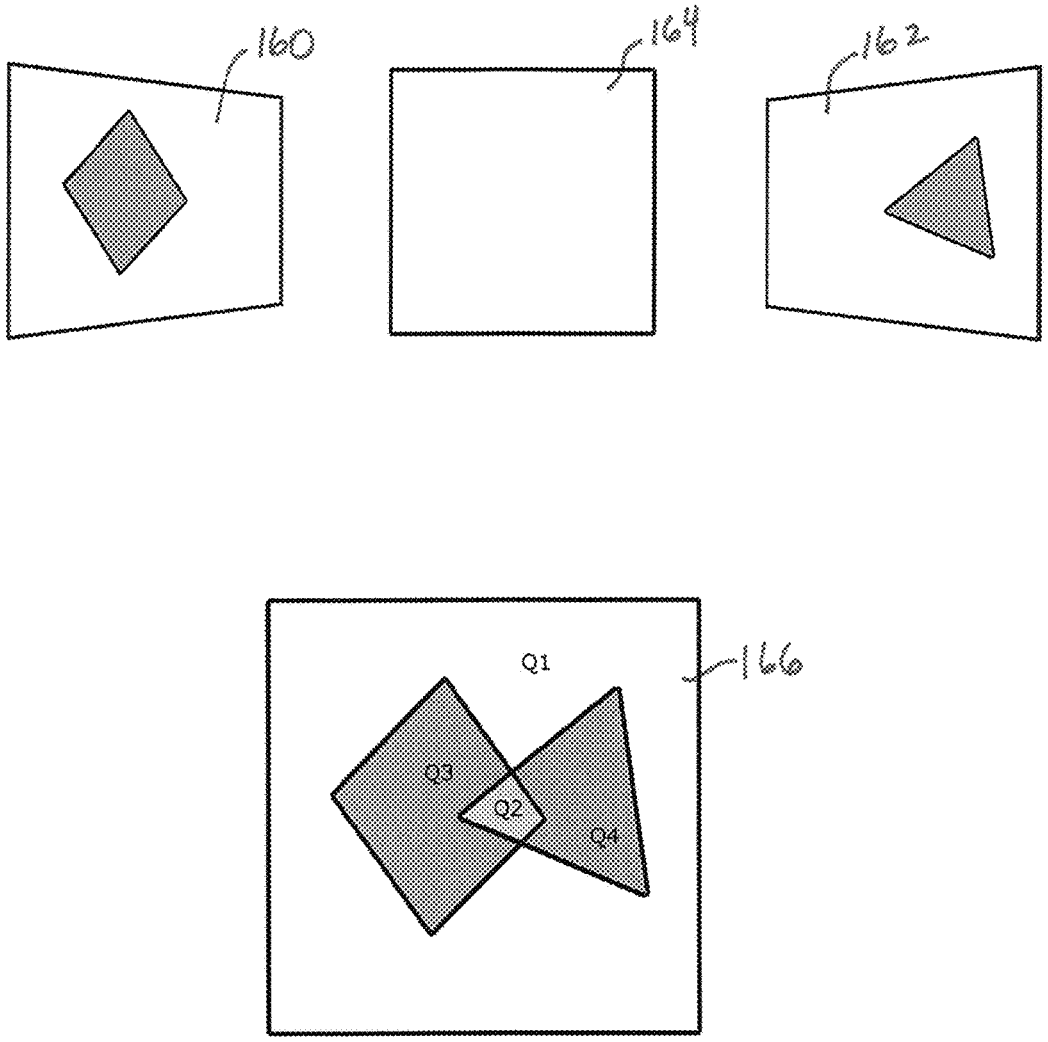
FIG. 11 depicts how three frames integrate the four interlace units with graphical representation for a weave arrangement in accordance with the subject technology.

FIG. 11 depicts how the three frames integrate the four interlace units 140, 142, 144, 146 with a graphical representation of the left view 160 (one sub-component of the fabric 100), the right view (another component of the fabric 100) and a central view (the ridges and valleys component). The combined view 166 shows how three images create four distinct designs Q1, Q2, Q3, Q4 where the two backgrounds and two figures overlap.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A method for weaving a multi-image graphical fabric comprising the steps of:

assigning groups, each group having first, second and third yarns, wherein a first group has the first yarn being for a valley position in a most suppressed position and the second and third yarns being a first pair for a slope position in relatively raised positions, a second group has a first yarn for a ridge position with the second and third yarn forming a second pair for a slope in a descending position resulting in a combination of six fill yarns across twelve warp ends to form a weave unit so that three separate and distinct image fields are created in a face of the fabric and viewing angle determines which image field is seen.

2. A method as recited in claim 1, further comprising the step of forming the first and second pairs from yarns of a substantially constant diameter.

3. A method as recited in claim 1, further comprising the step of forming the first and second pairs in contrasting colors and tonalities to delineate a pattern.

4. A method as recited in claim 1, wherein each of the three image fields conforms to a same repeat size that is divisible into a final number of fill rows and warp end columns making up a complete interlace draft, wherein the fill rows run horizontally on the interlace draft and perpendicular to the warp end columns.

5. A method as recited in claim 4, further comprising the step of using tension of the warp yarns to force the fill yarns into the valley, slope, ridge and descending positions in a systematic and repeating order to result in a corrugated-like effect of ridges and valleys where one image plane becomes visually evident in the fill yarns from one direction and another image plane becomes visually evident from the other direction.

6. A method as recited in claim 5, wherein the ridge position and the valley position are created by a single yarn in each position, and the slope and descending positions are created by two yarns to present a unified surface quality when the fabric viewed from a perpendicular angle, while, when the fabric is viewed from an acute angle, the ridges serve to obscure the image on the other image plane.

7. A multi-image weave comprising:

a fabric having three image frames, each of the image frames being separated into rows, a number of these rows corresponding to a number for fill yarn rows required for each image frame to complete a design repeat rotation and produce a consistent and evenly repeating length of material, wherein the rows of the three designs are collated in sequence and in coordination with a fill row assignment creating a plurality of unique interlace units that designate how the image frames correspond to one another when integrated with different areas of figure and ground delineation connecting at sequential fill rows and sequential warp ends.

* * * * *